US006875058B2

(12) United States Patent
Brock et al.

(10) Patent No.: US 6,875,058 B2
(45) Date of Patent: Apr. 5, 2005

(54) ELECTRICAL ADAPTER FOR A FUEL INJECTOR WITH TWO SETS OF CONNECTORS

(75) Inventors: Gregory D. Brock, Peoria, IL (US); Charles D. Ellenbecker, Bloomington, IL (US); Frederick M. Estes, Tremont, IL (US); Wade D. Scrivner, Lexington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/160,717

(22) Filed: May 31, 2002

(65) Prior Publication Data

US 2003/0224664 A1 Dec. 4, 2003

(51) Int. Cl.[7] ..... H01R 25/00

(52) U.S. Cl. ..... 439/638; 439/300; 439/76; 439/902

(58) Field of Search ..... 439/300, 638, 439/626, 628, 890, 396, 76, 77, 902, 881, 694

(56) References Cited

U.S. PATENT DOCUMENTS 4,225,206 A * 9/1980 Roman, Jr. ..... 439/274
4,950,171 A * 8/1990 Muzslay ..... 439/76.1
4,959,027 A * 9/1990 Muzslay ..... 439/655
5,607,315 A * 3/1997 Bonnah et al. ..... 439/130
6,461,171 B2 * 10/2002 Kanaoka et al. ..... 439/76.2

* cited by examiner

*Primary Examiner*—Gary Paumen
*Assistant Examiner*—Edwin A. Leon
(74) *Attorney, Agent, or Firm*—Jason J. Stanley

(57) ABSTRACT

A fuel injector assembly for use in an electrically-controlled engine having a fuel injector and an electrical adapter. The fuel injector has a first set of electrical connectors and a second set of electrical connectors. The electrical adapter has a body, a first set of electrical receptacles, a second set of electrical receptacles, and a plug interface. The first set of electrical receptacles are electrically connectable with the first set of electrical connectors. The second set of electrical receptacles are electrically connectable with the second set of electrical connectors. The plug interface has a first set of electrical contacts electrically connected to the first set of electrical receptacles. The plug interface also has a second set of electrical contacts electrically connected to the second set of electrical receptacles.

32 Claims, 5 Drawing Sheets

ELECTRICAL ADAPTER FOR A FUEL INJECTOR WITH TWO SETS OF CONNECTORS

TECHNICAL FIELD

This invention relates generally to electrical adapters, and more particularly to an electrical adapter having one plug interface and multiple sets of press-fit electrical receptacles.

BACKGROUND

In recent years internal combustion engine manufacturers have faced the challenge of increasing the power output of engines while also improving fuel economy and reducing emissions. One manner of meeting these challenges has been the production of fuel injectors that more finely control the injection of fuel into the combustion chamber of the engine. One of such fuel injectors created by Caterpillar Inc. is a hydraulically-actuated electronically-controlled unit fuel injector that employs two electrically-controlled mechanisms to regulate the injection of fuel.

To permit control of this type of fuel injector, each of the mechanisms is electrically connected to a control device, such as an electronic control module ("ECM"). Therefore, the exterior of the fuel injector is equipped with two sets of electrical connectors, one for each of the mechanisms. The electrical connections between the ECM and the electrical connectors are typically created by control wires. Control wires from the ECM may be directly connected to each set of electrical connectors, but connecting the control wires is often difficult and time-consuming due to the orientation of the electrical connectors and the close proximity of other engine components to the fuel injector. This difficulty is not only realized upon initial installation of the fuel injector but also at any time when the fuel injector must be removed or re-installed, such as during routine servicing. Therefore, there is a need for an electrical adapter that will permit quicker and easier connection of the control wires to the fuel injector, and therefore quicker and easier installation and removal of the fuel injector.

SUMMARY OF THE INVENTION

In one aspect of an apparatus of the present application, an electrical adapter has a body, a first set of electrical receptacles, and a second set of electrical receptacles. The adapter further has a plug interface. The plug interface contains a first set of electrical contacts and a second set of electrical contacts. The first set of electrical contacts is electrically connected to the first set of electrical receptacles, and the second set of electrical contacts is electrically connected to the second set of electrical receptacles.

In another aspect of an apparatus of the present application, a fuel injector assembly has a fuel injector and an adapter. The fuel injector has a body, a first set of electrical connectors, a second set of electrical connectors, a first mechanism, and a second mechanism. The first set of electrical connectors is electrically connected to the first mechanism, and the second set of electrical connectors is electrically connected to the second mechanism. The adapter has a first set of electrical receptacles, a second set of electrical receptacles, a first set of electrical contacts, and a second set of electrical contacts. The first set of electrical receptacles is electrically connected to the first set of electrical contacts, and the second set of electrical receptacles is electrically connected to the second set of electrical contacts.

The first set of electrical receptacles of the adapter are engaged with the first set of electrical connectors of the fuel injector, and the second set of electrical receptacles of the adapter are engaged with the second set of electrical connectors of the fuel injector.

In one aspect of a method of the present application, a method of electrically connecting a power source to a fuel injector assembly includes aligning at least one of a first set of electrical receptacles of an electrical adapter and a second set of electrical receptacles of an electrical adapter with at least one of a first set of electrical connectors of a fuel injector and a second set of electrical connectors of a fuel injector. The electrical adapter is connected to the fuel injector so that the first set of electrical receptacles is in electrical contact with the first set of electrical connectors and the second set of electrical receptacles is in electrical contact with the second set of electrical receptacles.

DETAILED DESCRIPTION

Referring to the Figs., an internal combustion engine 10 is shown. The engine 10 includes a cylinder block 12, a cylinder head 14 attached to the block 12, and a valve cover 16 attached to the head 14. These components are of a generally conventional design.

Figure 1:
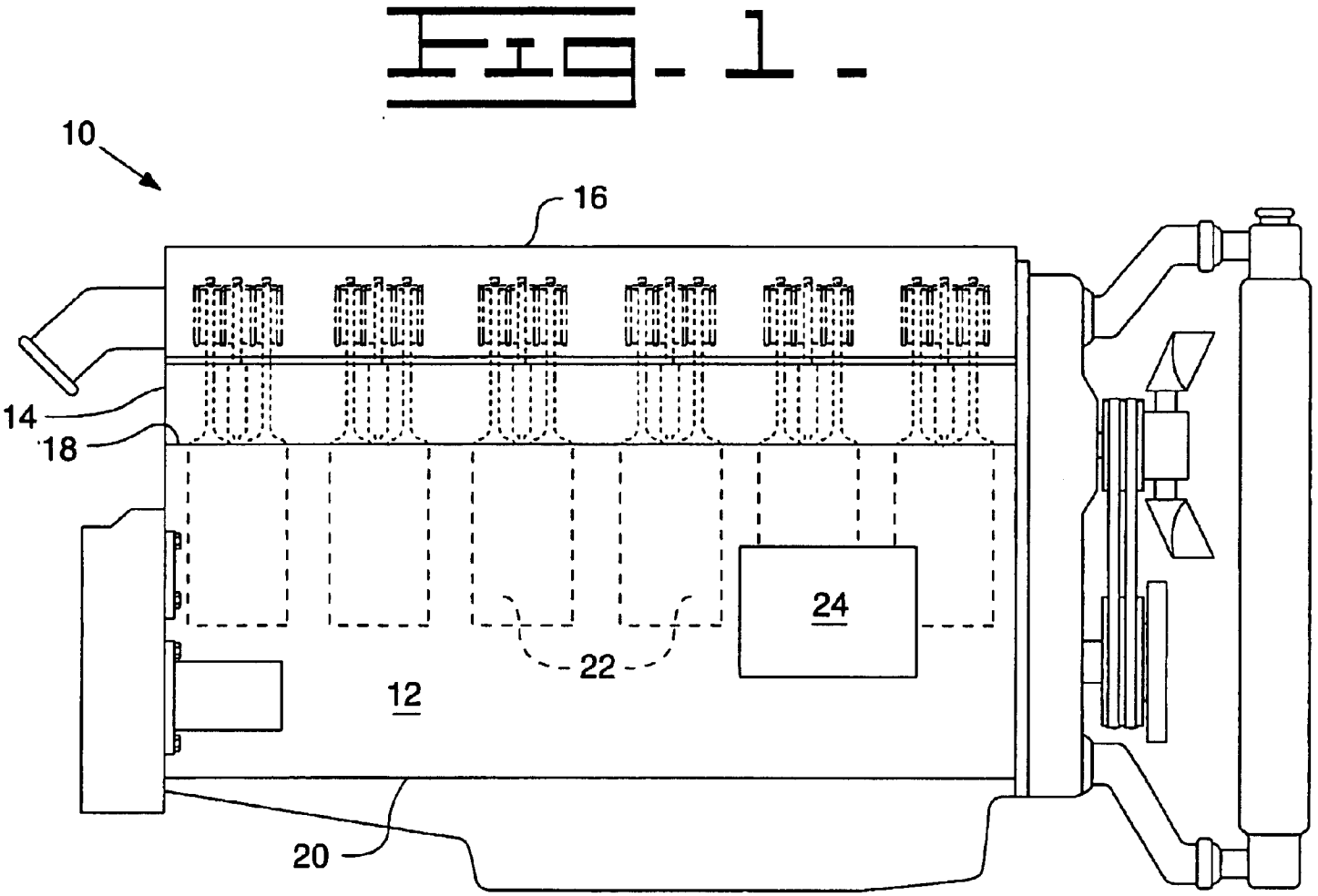
FIG. 1 is a side view of an engine.
Figure 2:
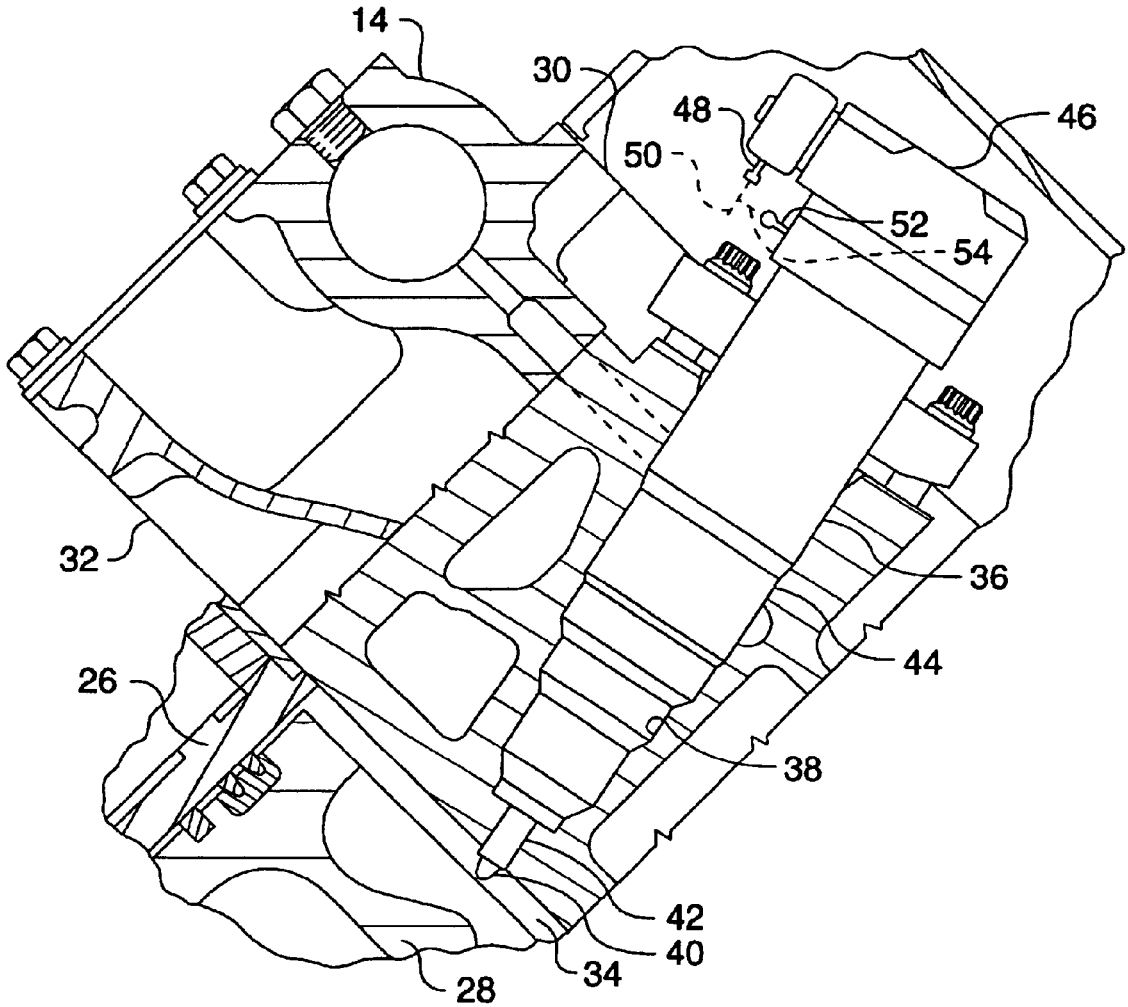
FIG. 2 is a cross sectional view of the engine.

Referring now to FIG. 1, the block 12 includes a top mounting surface 18, a bottom mounting surface 20, and a plurality of cylinder bores 22 located between the top mounting surface 18 and the bottom mounting surface 20. Also, an electronic control module ("ECM") 24 is attached to the block 12. In the embodiment shown in FIG. 1, six cylinder bores 22 are equally spaced, in-line, and perpendicularly positioned with respect to the top mounting surface 18. However, the cylinder block 12 may be of any other conventional design, such as "V" or radial, and may have any number of bores 22 equally or unequally spaced. Referring to FIG. 2, a cylinder liner 26 is positioned within one of the cylinder bores 22, and a conventional piston 28 is positioned within the cylinder liner 26. The piston 28 is moveable between a top dead center position and a bottom dead center position by a crankshaft, not shown, in a conventional manner.

Referring to FIG. 2, the cylinder head 14 includes a valve cover mounting surface 30 and a block mounting surface 32. The cylinder head 14 is attached to the block 12 by a plurality of bolts, not shown. The cylinder head 14, the cylinder liner 26 and the piston 28 define a combustion zone 34. A fuel injector 36 is positioned in a bore 38 in the cylinder head 14. The fuel injector 36 has a first end 40 defined by a nozzle portion 42. The fuel injector 36 has a body 44 extending from the nozzle portion 42 to a second end 46. In the embodiment of the engine 10 in FIG. 2, the first end 40 of the fuel injector 36 extends into the combustion zone 34. However, one of ordinary skill in the art would recognize that other configurations are possible, including the extension of the first end 40 of the fuel injector 36 into a pre-chamber, not shown.

Figure 3:
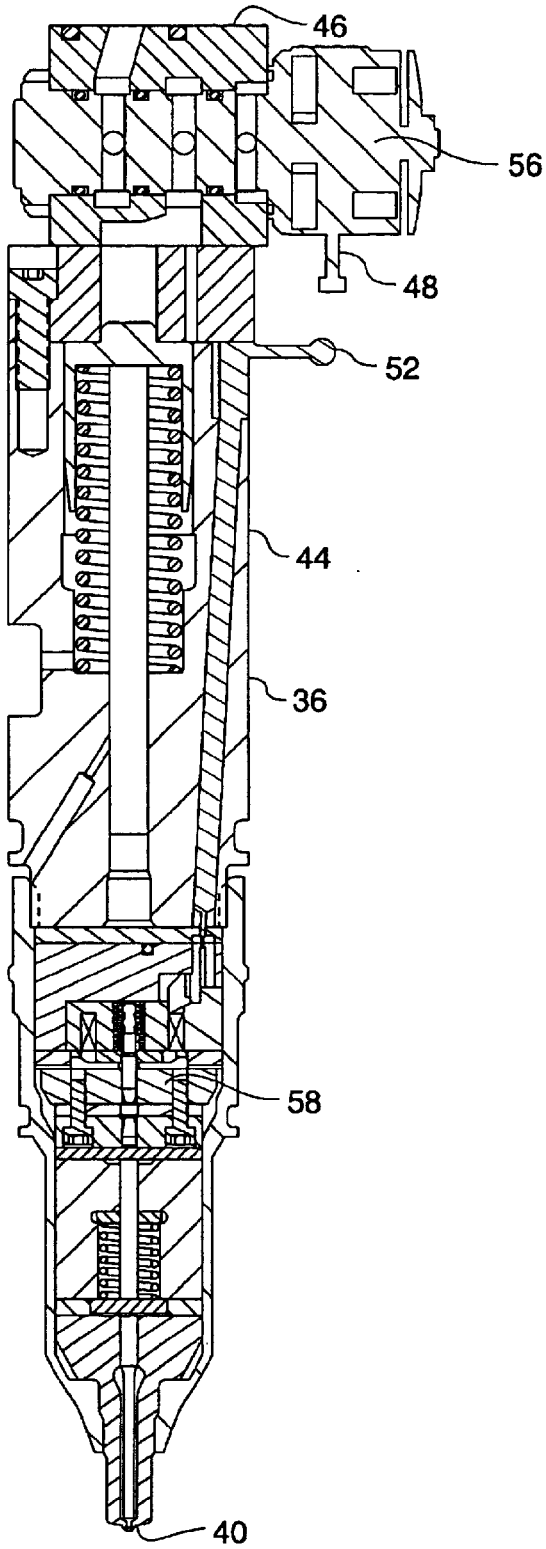
FIG. 3 is an enlarged cross-sectional view of a fuel injector.

Referring to FIG. 2, near the second end 46 of the fuel injector 36 a first set of electrical connectors 48 extends in a first direction, designated by the dashed line 50, from the fuel injector body 44. A second set of electrical connectors 52 extends in a second direction, designated by the dashed line 54, from the fuel injector body 44. In the embodiment shown in FIG. 2, the first direction 50 and the second direction 54 are substantially perpendicular to each other, but in other embodiments the first direction 50 and the second direction 54 may be parallel or positioned at any angle. In FIG. 3, the fuel injector 36 has a first mechanism 56 and a second mechanism 58. The first mechanism 56 is connected to the fuel injector body 44 proximate the second end 46 of the fuel injector 36. In the embodiment of the fuel injector 36 illustrated in FIG. 3, the second mechanism 58 is contained within the fuel injector body 44 and is spaced a defined distance from the first end 40 of the fuel injector 36. The first set of electrical connectors 48 is electrically connected to the first mechanism 56, and the second set of electrical connectors 52 is electrically connected to the second mechanism 58. In the embodiment of FIG. 3, the first mechanism 56 and the second mechanism 58 are both solenoids. However, one of ordinary skill in the art would appreciate that other electrically-controlled mechanisms may be used, such as one or more voice coils or piezoelectric actuators. Fuel injectors having two electrically-controlled mechanisms, such as the fuel injector 36 in FIG. 3, are commonly referred to as four-wire injectors.

Figure 4:
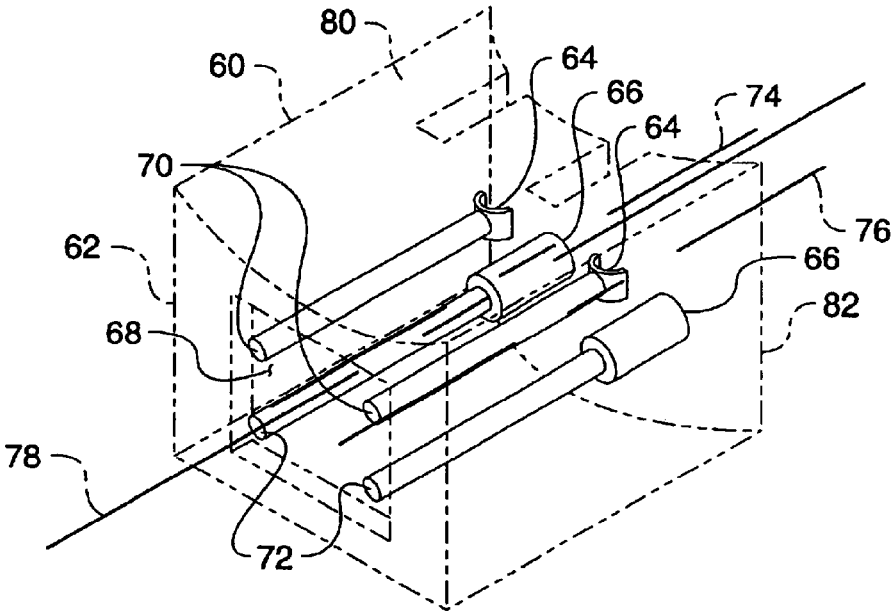
FIG. 4 is a perspective view of a first embodiment of an electrical adapter.

Referring to FIG. 4, one embodiment of an electrical adapter 60 of the present application has a body 62, a first set of electrical receptacles 64 connected to the body 62, a second set of electrical receptacles 66 connected to the body 62, and a plug interface 68 formed in the body 62. In the embodiment of the adapter 60 in FIG. 4, the plug interface 68 is recessed into the body 62 of the adapter 60. However, in other embodiments the plug interface 68 may be flush with the body 62 or extend outward from the body 62. The plug interface 68 has a first set of electrical contacts 70 and a second set of electrical contacts 72. The first set of electrical contacts 70 is electrically connected to the first set of electrical receptacles 64, and the second set of electrical contacts 72 is electrically connected to the second set of electrical receptacles 66. In the embodiment of FIG. 4, the first set of electrical receptacles 64 are clips, having an elastic property, that are dimensioned to engage in a press-fit connection with the first set of electrical connectors 48 of the fuel injector 36, shown in FIG. 3. In the embodiment of FIG. 4, the second set of electrical receptacles 66 are sockets that are dimensioned to engage in a press-fit connection the second set of electrical connectors 52 of the fuel injector 36, shown in FIG. 3. In other embodiments of the adapter 60, the first set of electrical receptacles 64 may be sockets, clips, or other press-fit structures dimensioned to engage the first set of electrical connectors 48 of the fuel injector 36, and the second set of electrical receptacles 66 may be sockets, clips, or other press-fit structures dimensioned to form a press-fit connection with the second set of electrical connectors 52.

Figure 5:
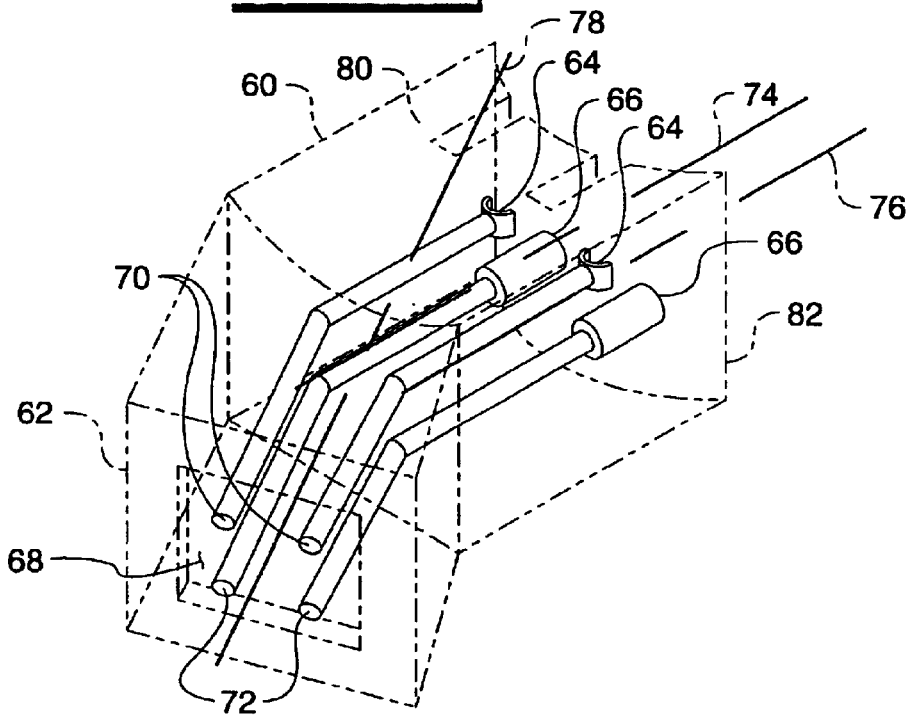
FIG. 5 is a perspective view of a second embodiment of an electrical adapter.

In the embodiment of the adapter 60 in FIG. 4, the first set of electrical receptacles 64 has a first longitudinal axis, designated by the dashed line 74, and the second set of electrical receptacles 66 has a second longitudinal axis, designated by the dashed line 76. In the embodiment of FIG. 4, the first longitudinal axis 74 and the second longitudinal axis 76 are substantially parallel. However, the first longitudinal axis 74 and the second longitudinal axis 76 may also be positioned at any defined angle. Referring to FIG. 4, the plug interface 68 of the adapter 60 has a defined interface axis, designated by the dashed line 78. In the embodiment of the adapter 60 of FIG. 4, the interface axis 78 of the plug interface 68 is substantially parallel to both the first longitudinal axis 74 of the first set of electrical receptacles 64 and the second longitudinal axis 76 of the second set of electrical receptacles 66. However, the interface axis 78 may be positioned from one or both of the first longitudinal axis 74 and the second longitudinal axis 76 at any defined angle. For example, in the embodiment of the adapter 60 of FIG. 5, the interface axis 78 of the plug interface 68 is positioned with respect to both the first longitudinal axis 74 of the first set of electrical receptacles 64 and the second longitudinal axis 76 of the second set of electrical receptacles 66 at an angle of approximately 45°.

In the embodiment of the adapter 60 in FIG. 4, the body 62 of the adapter 60 has a first surface 80 and a second surface 82. The first surface 80 is dimensioned to mate with the body 44 of the fuel injector 36 proximate the first set of electrical connectors 48, and the second surface 82 is dimensioned to mate with the body 44 of the fuel injector 36 proximate the second set of electrical connectors 52. For purposes of this application, the phrase "mate with" shall mean "fit against or fit close to." In the embodiment of the adapter 60 in FIG. 4, the second set of electrical receptacles 66 intersects the second surface 82 of the body 62 of the adapter 60, and the first set of electrical receptacles 64 is recessed into the adapter 60 a defined distance from the second surface 82. In another embodiment of the adapter 60, the first set of electrical receptacles 64 intersects the first surface 80 of the body 62 of the adapter 60, and the second set of electrical receptacles 66 is recessed into the adapter 60 a defined distance from the first surface 80.

Figure 6:
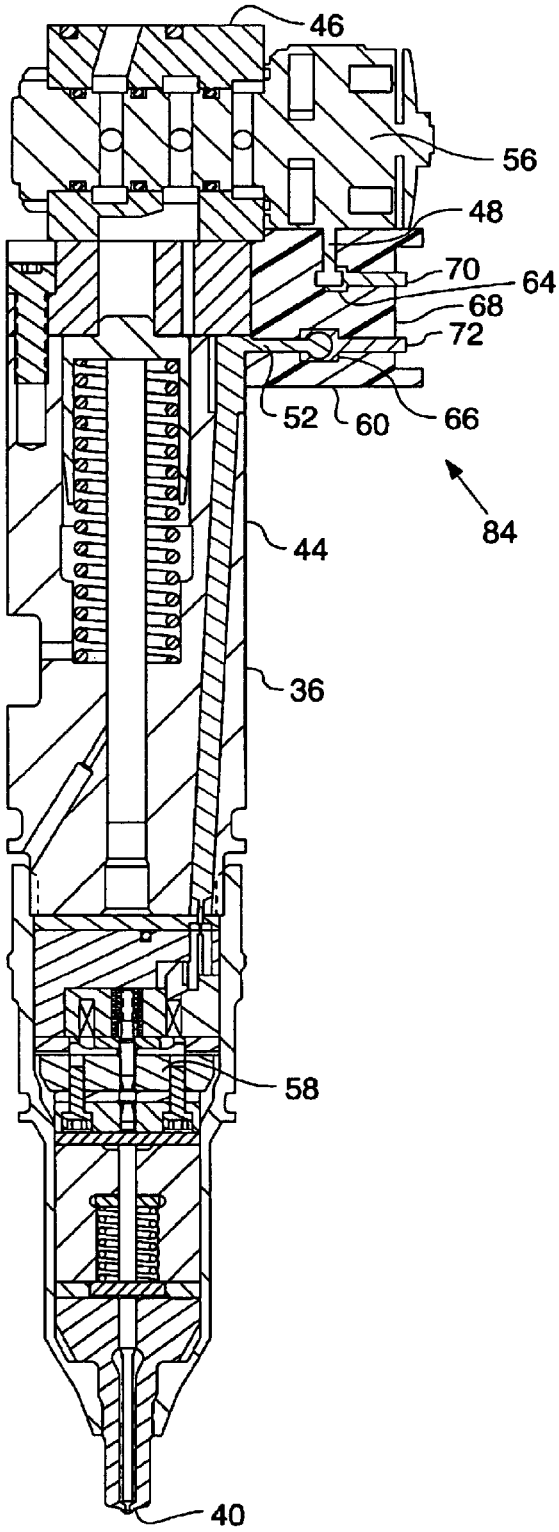
FIG. 6 is an enlarged cross-sectional view of a fuel injector assembly.

Referring to FIG. 6, in one embodiment of the fuel injector assembly 84 of the present application, the first set of electrical connectors 48 of the fuel injector 36 are engaged with the first set of electrical receptacles 64 of the adapter 60 in a press-fit connection, and the second set of electrical connectors 52 of the fuel injector 36 are engaged with the second set of electrical receptacles 66 of the adapter 60 in a press-fit connection. Therefore, the first set of electrical connectors 48, the first set of electrical receptacles 64, and the first set of electrical contacts 70 are all electrically connected to the first mechanism 56. In addition, the second set of electrical connectors 52, the second set of electrical receptacles 66, and the second set of electrical contacts 72 are all electrically connected to the second mechanism 58.

All embodiments of the adapter illustrated in the Figs. have two sets of electrical receptacles, 64 and 66, and one plug interface 68. However, other embodiments of the adapter 60 are possible, including embodiments with three or more sets of electrical receptacles and multiple plug interfaces.

Industrial Applicability

The adapter 60 of the present application may be attached to a fuel injector 36 either before or after the fuel injector 36 is installed in the cylinder head 14 of the engine 10. Attaching the embodiment of the adapter 60 illustrated in FIG. 4 to the fuel injector 36 of FIG. 3 is accomplished by aligning the first set of electrical receptacles 64 with the first set of electrical connectors 48 and aligning the second set of electrical receptacles 66 with the second set of electrical connectors 52. The second surface 82 of the body 62 of the adapter 60 is then moved towards the second set of electrical connectors 52 of the fuel injector 36 until the sockets of the second set of electrical receptacles 66 surround the second set of electrical connectors 52 and the clips of the first set of electrical receptacles 64 contact the first set of electrical connectors 48. Motion of the adapter 60 is then continued in the same direction until the pressure caused by the motion overcomes the elastic resistance of the clips of the first set of electrical receptacles 64 and the clips engage the first set of electrical connectors 48. Either one or both of the elastic force of the clips acting on the first set of electrical connectors 48 and the frictional force between the sockets of the second set of electrical receptacles 66 and the second set of electrical connectors 52 holds the adapter 60 attached to the fuel injector 36 via a press-fit connection. The contact between the clips and the first set of electrical connectors 48 creates an electrical connection between the first set of electrical connectors 48 and the first set of electrical contacts 70, and the contact between the sockets and the second set of electrical connectors 52 creates an electrical connection between the second set of electrical contacts 72 and the second set of electrical connectors 52.

The control wires from the ECM 24 can be attached to the sets of electrical contacts, 70 and 72, of the plug interface 68 of the adapter 60 either before or after the adapter 60 is attached to the fuel injector 36. Each control wire may be individually attached to each electrical contact, 70 and 72, in the plug interface 68 or the control wires may be attached to a plug, not shown, that is configured to engage the sets of electrical contacts, 70 and 72, of the plug interface 68. Upon connection of the control wires to the adapter 60 and attachment of the adapter 60 to the fuel injector 36, the first mechanism 56 and second mechanism 58 are electrically connected to the ECM 24 via the electrical connectors, 48 and 52, electrical receptacles, 64 and 66, electrical contacts, 70 and 72, and control wires.

Removal of the adapter 60, in the embodiment illustrated in FIG. 4, from the fuel injector 36 is accomplished by exerting a force on the adapter 60 in a direction away from the body 44 of the fuel injector 36 proximate the second set of electrical connectors 52 and towards the plug interface 68 of the adapter 60. When the force is strong enough to overcome the elastic force of the clips of the first set of electrical receptacles 64 acting on the first set of electrical connectors 48 and the frictional force between the sockets of the second set of electrical receptacles 66 and the second set of electrical connectors 52, the press-fit connection is severed and the adapter 60 separates from the fuel injector 36. Thus, all of the control wires are removed from contact with the fuel injector 36 and the fuel injector 36 may be removed from the cylinder head 14. Therefore, installation and removal of the fuel injector 36 is made simpler and quicker by the adapter 60 of the present application.

Although the adapter 60 of the present application has been described in connection with a fuel injector 36, various embodiments of the adapter 60 could be used with other structures having multiple electrical connectors. Therefore, the adapter 60 of the present application is not limited to use with internal combustion engines 10, but may be used in any situation in which it would be beneficial to combine multiple electrical connectors into one plug interface.

Other aspects, objects, and advantages of this invention can be obtained from a study of the drawings, the disclosure, and the appended claims.

What is claimed is:

1. A fuel injector assembly for use in a electrically-controlled engine, said fuel injector assembly comprising:

a fuel infector having a first set of electrical connectors and a second set of electrical connectors; and an electrical adapter having:

a body;

a first set of electrical receptacles connected to said body, said first set of electrical receptacles being electrically connectable with said first set of electrical connectors;

a second set of electrical receptacles connected to said body, said second set of electrical receptacles being electrically connectable with said second set of electrical connectors; and a plug interface having a first set of electrical contacts and a second set of electrical contacts, said first set of electrical contacts electrically connected to said first set of electrical receptacles, and said second set of electrical contacts electrically connected to said second set of electrical receptacles.

2. The fuel injector assembly of claim 1 wherein at least one of said first set of electrical receptacles and said second set of electrical receptacles are clips.

3. The fuel injector assembly of claim 1 wherein at least one of said first set of electrical receptacles and said second set of electrical receptacles are sockets.

4. The fuel injector assembly of claim 1 wherein said first set of electrical receptacles has a first longitudinal axis and said second set of electrical receptacles has a second longitudinal axis.

5. The fuel injector assembly of claim 4 wherein said first longitudinal axis and said second longitudinal axis are positioned with a defined angle therebetween.

6. The fuel injector assembly of claim 5 wherein said defined angle is approximately 90°.

7. The fuel injector assembly of claim 4 wherein said plug interface has a defined interface axis.

8. The fuel injector assembly of claim 7 wherein said defined interface axis is substantially parallel with at least one of said first longitudinal axis of said first set of electrical receptacles and said second longitudinal axis of said second set of electrical receptacles.

9. The fuel injector assembly of claim 7 wherein said defined interface axis is positioned with respect to at least one of said first longitudinal axis of said first set of electrical receptacles and said second longitudinal axis of said second set of electrical receptacles at a defined angle.

10. The fuel injector assembly of claim 9 wherein said defined angle is approximately 45°.

11. The fuel injector assembly of claim 1 wherein said body has a first surface dimensioned to mate with said fuel injector.

12. The fuel injector assembly of claim 11 wherein at least one of said first set of electrical receptacles and said second set of electrical receptacles intersects said first surface.

13. The fuel injector assembly of claim 11 wherein at least one of said first set of electrical receptacles and said second set of electrical receptacles is recessed into said body a defined distance from said first surface.

14. The fuel injector assembly of claim 1 wherein said body has a second surface dimensioned to mate with said fuel injector.

15. The fuel injector assembly of claim 14 wherein at least one of said first set of electrical receptacles and said second set of electrical receptacles intersects said second surface.

16. The fuel injector assembly of claim 14 wherein at least one of said first set of electrical receptacles and said second set of electrical receptacles is recessed into said body a defined distance from said second surface.

17. A fuel injector assembly comprising:

a fuel injector having a body, a first set of electrical connectors extending in a first direction from said body, a second set of electrical connectors extending in a second direction from said body, a first mechanism for performing a first function, said first mechanism connected to said body and electrically connected to said first set of electrical connectors, and a second mechanism for performing a second function, said second mechanism connected to said body and electrically connected to said second set of electrical connectors; and an adapter connected to said fuel injector, said adapter having a body, a first set of electrical receptacles connected to said adapter body and engaged with said first set of electrical connectors, a second set of electrical receptacles connected to said adapter body and engaged with said second set of electrical connectors, and a plug interface formed in said adapter body, said plug interface having a first set of electrical contacts and a second set of electrical contacts, said first set of electrical contacts electrically connected to said first set of electrical receptacles and said second set of electrical contacts electrically connected to said second set of electrical receptacles.

18. The fuel injector assembly of claim 17 wherein said adapter is connected to said fuel injector by a press-fit connection.

19. The fuel injector assembly of claim 17 wherein at least one of said first set of electrical receptacles and said second set of electrical receptacles are clips.

20. The fuel injector assembly of claim 17 wherein at least one of said first set of electrical receptacles and said second set of electrical receptacles are sockets.

21. The fuel injector assembly of claim 17 wherein said fuel injector is a four-wire fuel injector.

22. The fuel injector assembly of claim 17 wherein at least one of said first mechanism and said second mechanism is a solenoid.

23. The fuel injector assembly of claim 17 wherein at least one of said first mechanism and said second mechanism is a voice coil.

24. The fuel injector assembly of claim 17 wherein at least one of said first mechanism and said second mechanism is a piezoelectric actuator.

25. The fuel injector assembly of claim 17 wherein said plug interface has a defined interface axis.

26. The fuel injector assembly of claim 25 wherein said defined interface axis is substantially parallel to at least one of said first direction and said second direction.

27. The fuel injector assembly of claim 25 wherein said defined interface axis and at least one of said first direction and said second direction are positioned with a defined angle therebetween.

28. The fuel injector assembly of claim 27 wherein said defined angle is approximately 45°.

29. The fuel injector assembly of claim 17 wherein said first direction and said second direction are positioned with a defined angle therebetween.

30. The fuel injector assembly of claim 29 wherein said defined angle is approximately 90°.

31. A method of electrically connecting a control device to a fuel injector assembly, said fuel injector assembly having a fuel injector and an electrical adapter, said fuel injector having a first set of electrical connectors, a second set of electrical connectors, a first mechanism and a second mechanism, said first set of electrical connectors connected to said fuel injector and electrically connected to said first mechanism, and said second set of electrical connectors connected to said fuel injector and electrically connected to said second mechanism, said electrical adapter having a first set of electrical receptacles and a second set of electrical receptacles, said method comprising:

aligning at least one of said first set of electrical receptacles and said second set of electrical receptacles with at least one of said first set of electrical connectors and said second set of electrical connectors; and attaching said electrical adapter to said fuel injector such that said first set of electrical receptacles is in electrical contact with said first set of electrical connectors and said second set of electrical receptacles is in electrical contact with said second set of electrical connectors.

32. The method as specified in claim 31 wherein attaching said electrical receptacle to said fuel injector is accomplished by a press-fit connection.

* * * * *